US008388648B2

(12) United States Patent
Sgobero

(10) Patent No.: US 8,388,648 B2
(45) Date of Patent: Mar. 5, 2013

(54) TWEEZERS FOR COSMETIC USE

(75) Inventor: Nicole Sgobero, Montignez (CH)

(73) Assignee: Manufactures D'Outils Dumont SA, Montignez (CH)

( * ) Notice: Subject to any disclaimer, the term of this patent is extended or adjusted under 35 U.S.C. 154(b) by 651 days.

(21) Appl. No.: 11/591,946

(22) Filed: Nov. 2, 2006

(65) Prior Publication Data

US 2007/0112378 A1 May 17, 2007

Related U.S. Application Data

(63) Continuation of application No. PCT/EP2005/051637, filed on Apr. 13, 2005.

(30) Foreign Application Priority Data

May 3, 2004 (CH) ..... 0770/04

(51) Int. Cl.
*A61B 17/50* (2006.01)

(52) U.S. Cl. ..... 606/210; 294/99.2

(58) Field of Classification Search ..... 606/51, 606/52, 205–208, 210, 211, 131, 133, 36; 294/99.2, 16, 99.1; D28/55, 9; D24/143
See application file for complete search history.

(56) References Cited

U.S. PATENT DOCUMENTS

| | | | | | |
|---|---|---|---|---|---|
| 838,662 | A * | 12/1906 | Stephens | 294/99.2 |
| 1,715,089 | A * | 5/1929 | Jones | 81/64 |
| 3,115,360 | A * | 12/1963 | Witkoff | 294/99.2 |
| 3,378,010 | A * | 4/1968 | Codling et al. | 606/157 |
| 4,212,305 | A * | 7/1980 | Lahay | 606/210 |
| 4,286,514 | A * | 9/1981 | Wilson | 100/211 |
| 4,527,331 | A * | 7/1985 | Lasner et al. | 30/135 |
| 4,761,028 | A * | 8/1988 | Dulebohn | 294/99.2 |
| 5,358,297 | A | 10/1994 | Coleman | |
| 5,709,423 | A * | 1/1998 | Romero | 294/25 |
| 6,471,515 | B2 * | 10/2002 | Feuer | 433/162 |
| 6,863,679 | B1 * | 3/2005 | Aaron | 606/210 |
| 6,866,314 | B2 * | 3/2005 | Cho | 294/99.2 |
| 6,916,054 | B1 * | 7/2005 | Baldesberger | 294/99.2 |
| 2005/0035614 | A1 * | 2/2005 | Wessel | 294/99.2 |

FOREIGN PATENT DOCUMENTS

GB 29221 0/1910

OTHER PUBLICATIONS

Search report for application PCT/EP2005/051637.

* cited by examiner

*Primary Examiner* — Kathleen Sonnett
*Assistant Examiner* — Jocelin Tanner
(74) *Attorney, Agent, or Firm* — Pearne & Gordon LLP

(57) ABSTRACT

Tweezers for cosmetic use having two branches (3) with one metallic extremity (2) for seizing small objects, the maximum width of both branches (3) being greater than half the average width of the resting surface of the thumb of an adult user of average corpulence when said tweezers are actuated, and the maximum length of both branches (3) being less than the average length of the thumb of an adult of average corpulence. Even a person of reduced dexterity is thus capable of easily holding the inventive tweezers between two fingers to close them. Furthermore, the width of the branches (3) prevents the latter from sliding between the user's fingers and/or the tweezers from turning involuntarily when they are closed, even strongly or askew.

26 Claims, 2 Drawing Sheets

TWEEZERS FOR COSMETIC USE

REFERENCE DATA

Figure 1:
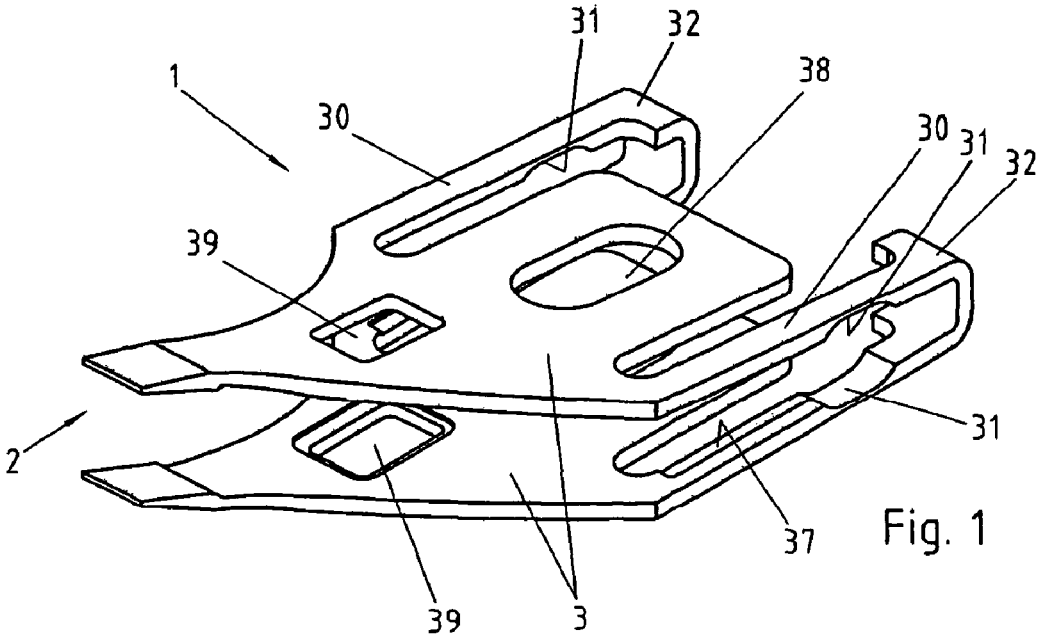

The present application is a continuation in part of international patent application PCT/EP2005/051637 (WO05112686), filed on Apr. 13, 2005, the content of which is included by reference, and claiming priority of CH2004/00770 of May 3, 2004, the content of which is included by reference.

FIELD OF THE INVENTION

The present invention concerns pincers for cosmetic use. The present invention concerns in particular tweezers for cosmetic use.

RELATED ART

Tweezers are small pincers formed of one generally flat extremity that extends into two branches acting like a spring and that allow very small objects to be gripped or high precision tasks to be performed. Some tweezers are designed for cosmetic use. They are generally used for depilation, their small size allowing them in particular to seize and pull out hairs accurately.

The prior art tweezers, in particular tweezers for cosmetic use, are generally slim and long. Their branches are thus narrow and elongated. This commonly accepted form however has several disadvantages. The handling of the prior art tweezers can in fact prove uncomfortable, in particular for people of reduced dexterity such as for example older people. The prior art tweezers also tend to roll involuntarily between the user's fingers, for example when the latter presses too strongly or askew on the branches.

Tweezers are known in the prior art that have elongated and essentially narrow branches that are enlarged on a limited portion in order to provide a larger resting surface for actuating the tweezers. Such a construction however has the disadvantage that the resting surface extending on both sides of/around the branches' longitudinal axis offers a considerable lever blade allowing a significant torque of the latter when a force is applied close to one of its extremities. There is then a considerable risk that a user, pressing in off-center fashion when actuating the tweezers, causes a poor alignment between the jaws when closing or even damages the tweezers irreversibly, in particular if the articulation between the two branches is not very accurate and/or strong.

An aim of the present invention is to propose tweezers for cosmetic use that do not have the disadvantages of the prior art tweezers for cosmetic use.

This aim is achieved by the cosmetic tweezers having the characteristics of the independent claims, advantageous variant embodiments being further indicated by the dependent claims.

This aim is achieved in particular by tweezers for cosmetic use having two branches including one metallic extremity for seizing small objects, the maximum width of both branches being greater than half the average width of the resting surface of the thumb of an adult user of average corpulence when the tweezers are actuated, and the maximum length of both branches being less than the average length of the thumb of an adult of average corpulence. Even a person of reduced dexterity is thus capable of easily holding the inventive tweezers between two fingers to close them. Furthermore, the width of the branches prevents the latter from sliding between the user's fingers and/or the tweezers from turning involuntarily when they are closed, even strongly or askew.

Figure 2:
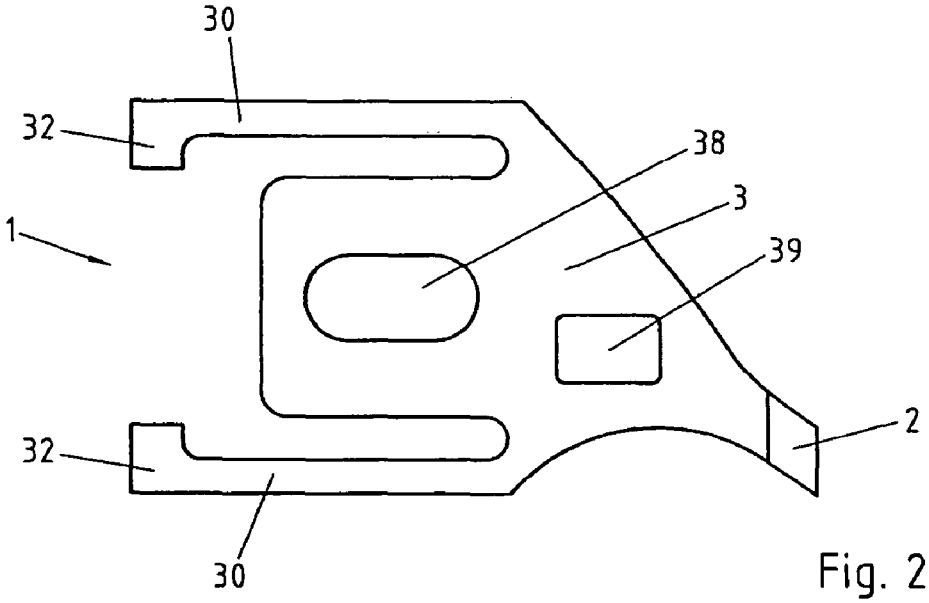
Figure 3:
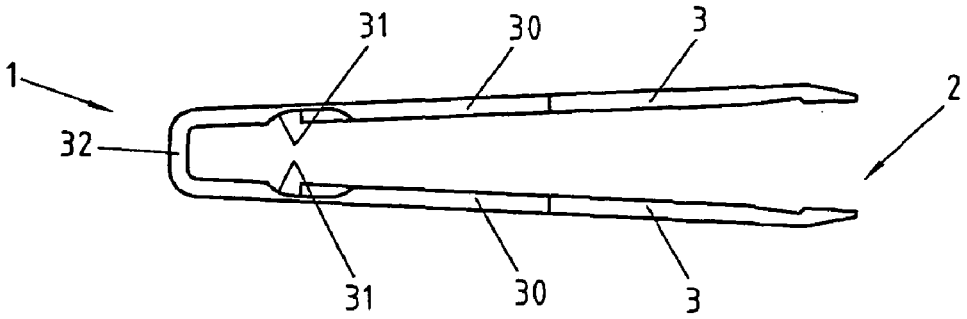
Figure 4:
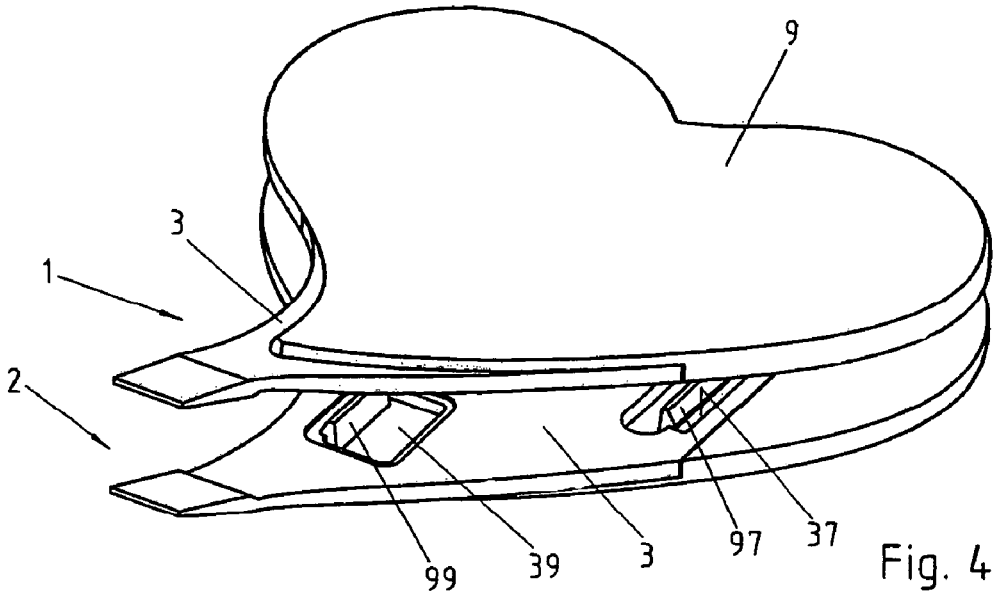
Figure 5:
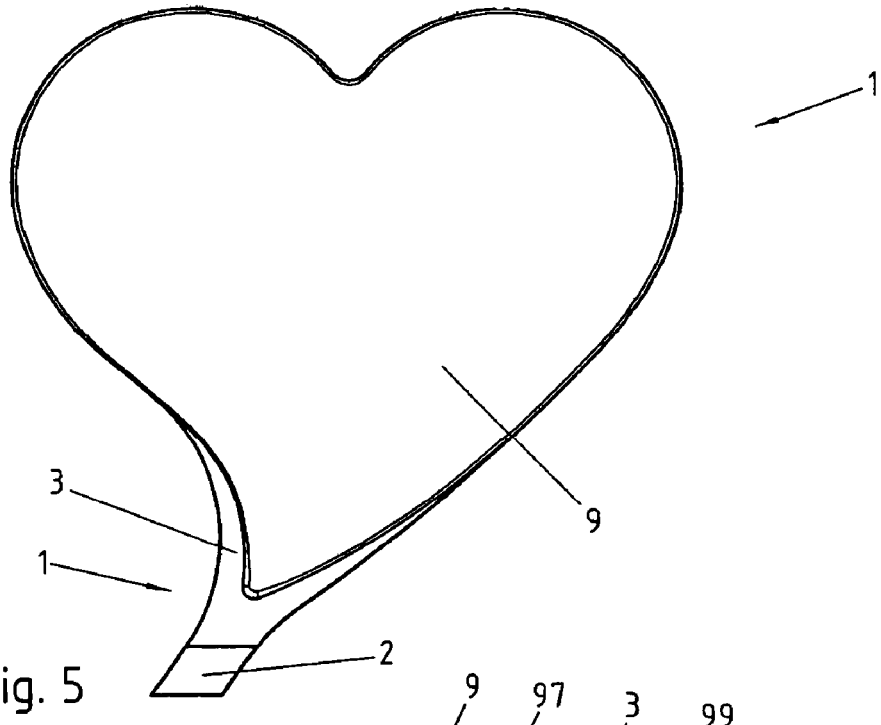
Figure 6:
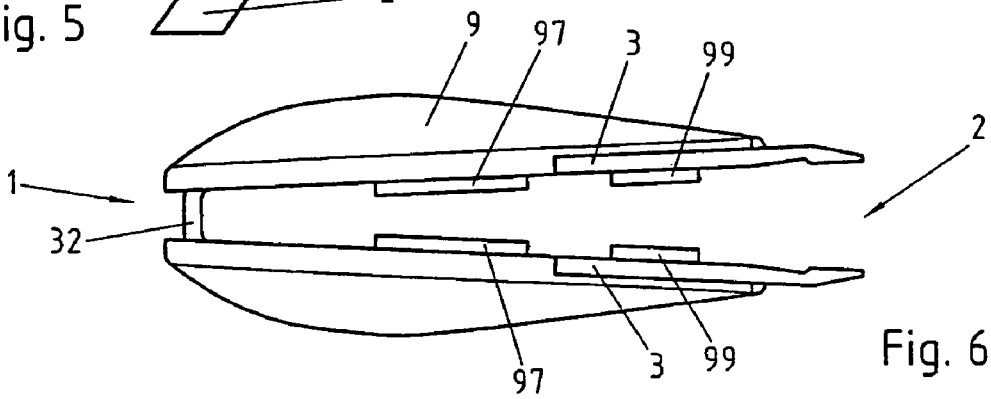

The present invention will be better understood with the aid of the description of a preferred embodiment illustrated by the FIGS. 1 to 6, where:

FIG. 1 is a perspective view of tweezers according to a preferred embodiment of the invention, FIG. 2 is a top view of the tweezers of FIG. 1, FIG. 3 is a profile view of the tweezers of FIG. 1, FIG. 4 is a perspective view of tweezers according to a preferred embodiment of the invention, having additional elements fastened on the branches, FIG. 5 is a top view of the tweezers of FIG. 2, FIG. 6 is a profile view of the tweezers of FIG. 2.

According to a preferred embodiment represented in FIGS. 1 to 3, the inventive tweezers include a preferably metallic frame structure 1 having one extremity 2, preferably narrow and for example flat, allowing small objects to be seized with accuracy. The one skilled in the art will understand that the shape of the extremity 2 is preferably adapted to the intended use of the tweezers. It can for example be pointed, bent, etc. According to a preferred embodiment, the inventive tweezers are designed for cosmetic use. The extremity 2 is thus preferably adapted to this kind of use, in particular for seizing and pulling out human hairs.

The extremity 2 becomes rapidly larger and extends in two branches 3 relatively wide compared with the extremity 2. According to the invention, the maximum width of the branches 3 is for example at least equal to half, preferably to two thirds, of the average width of the resting surface of the thumb of an adult of average corpulence when actuating the tweezers, so as to give the frame structure 1 rigidity in flexion and in torsion along the longitudinal axis and thus offer optimal comfort and accuracy of use. According to an even more preferred embodiment, the maximum width of the branches 3 is at least equal to the average resting surface of the thumb of an adult of average corpulence when actuating the tweezers. On the other hand, the maximum length of the branches 3 is preferably less than the average length of the thumb of an adult of average corpulence.

On the basis of a sampling performed during development of the inventive tweezers, the average width of the resting surface of the thumb of an adult of average corpulence when actuating the tweezers was assessed to be about 20 mm whilst the average length of the thumb lies around 55 mm, regardless of sex. The maximum width of the branches 3 is thus preferably greater than 20 mm, whilst their maximum length is preferably less than 55 mm. According to a preferred embodiment, the maximum width of the branches 3 is at least equal to half their maximum length, In the example illustrated, the branches 3 get larger from the extremity 2 over at least half of their length, then maintain their maximum width up to the connecting zone 32 connecting the two branches 3 and located at the other extremity. The outer dimensions of the widest part of the branches 3, which thus extends over half their length, are thus more or less those of a square.

The extremity 2 is on the other hand preferably narrow, similar to that of the prior art tweezers, so as to allow very small objects such as for example human hairs etc. to be seized easily and in isolation. The maximum width of the extremity 2 is thus preferably less than a third of the maximum width of the branches 3. According to an even more preferred embodiment, the maximum width of the extremity 2 is preferably less than a fifth of the maximum width of the branches 3.

The branches 3 are connected to one another through flexible blades 30 formed preferably in the widest part of the branches 3, acting in the manner of a spring against the closing of the tweezers 1. Preferably, each branch 3 has two blades 30, where each blade 30 extends the corresponding blade 30 of the other branch 3. The spring effect keeping the tweezers 1 open is preferably essentially ensured by the flexibility of the blades 30 themselves.

The flexibility of the blades 30 is for example determined and controlled by cutting out a recess 31 on each blade 30 thus locally reducing the latter's thickness. The recesses 31, in particular through selecting their size and symmetry, makes it possible to determine accurately the degree of flexibility of each blade 30 as well as the zone and direction along which most of the flexion will occur when the tweezers 1 are used. The recesses 31 are preferably located as far as possible from the extremity 2 in order to reduce maximally the angle formed between the branches 3 when the tweezers are closed and to ensure an optimum transmission onto the extremity 2 of the force exerted by the user on the branches 3.

The blades 30 of each branch 3 are preferably connected to the corresponding blades 30 of the other branch 3 through connecting zones 32 that are practically not deformed when the tweezers 1 are actuated, even if the pressing force on the branches 3 is very high. The connecting zones 32 are for example of the same material as the blades 30 but considerably larger than the latter, so that their rigidity is also considerably higher. The rigidity of the connecting zones 32 ensures notably that the extremity 2 of the tweezers closes correctly, by avoiding any lateral offset between the branches 3.

According to a preferred embodiment of the invention, the connecting zones 32 determine a certain distance of the branches 3 to one another, which means that when the inventive tweezers are open in resting position, the angular width between the branches 3 is relatively small or the branches 3 are even more or less parallel. The small angular width between the branches 3 when the extremity 2 is open thus gives the inventive tweezers an optimum comfort of use and an improved aesthetic aspect despite branches 3 that are relatively short.

The two blades 30 of a same branch 3 are preferably placed on each side of the branch 3 so as to be also as far away from one another as possible. This arrangement allows an optimum control of the accuracy with which the flat extremity 2 closes when the tweezers 1 are actuated. The distance of the blades 30 connecting the branches 3 to one another in fact prevents that the latter are offset laterally relatively to one another during closing.

It will clearly appear to the one skilled in the art that the number of blades 30 of each branch 3 can be chosen when the inventive tweezers are conceived, for example to adapt the latter to a particular use and/or give them a determined resistance. The branches 3 of the inventive tweezers 1 can thus for example include one, two, three or more flexible blades according to the aesthetic aspect and/or the operating comfort desired.

The frame structure 1 of the inventive tweezers is preferably formed by electro-discharging and then folding a metallic plate. The two branches 3 are thus cut out symmetrically and connected to one another through connecting zones 32. Once cut out, the frame structure is folded around the connecting zones 32. The folding is carried out with the utmost accuracy in order to ensure a correct aligning of the branches 3 and the distance sought between them.

The one skilled in the art will however understand that other embodiments are also possible within the frame of the invention. According to one variant embodiment, each branch 3 is for example manufactured separately then fastened directly or through a connecting element by the extremity of its rams 30 to another branch 3. The fastening occurs for example by welding, gluing, etc. Such an embodiment has however the disadvantage that is it more costly, more fragile and generally less accurate.

During their use, the inventive tweezers are preferably held by the user by the two branches 3, for example with the thumb and the index of the same hand. Contrary to the prior art tweezers, the inventive tweezers are preferably held with the thumb oriented upwards whilst the index is curved against the less branch. Holding the tweezers in such a manner allows the user to exert a more considerable force on the extremity 2 than in the case of the prior art tweezers that are generally actuated by the finger tips.

The user exerts a pressure on the outer surfaces of the branches 3, preferably on a zone situated between the recesses 31 and the flat extremity 2. The flexible blades then fold essentially in the zone of the recess 31 whilst the rest of the branches 3 keep their initial shape, which has the effect of closing the flat extremity 2, for example to seize a small object. When the pressure on the outer surfaces of the branches 3 is released by the user, the tweezers 1 then open under the force of the blades 30 that revert to their initial position.

According to a preferred embodiment of the invention, the extremity 2 is off-center relatively to the branches 3 and is connected to the latter along an axis different from their longitudinal axis. This off-center and off-axis position of the extremity 2 makes it possible to prevent the wide part of the frame structure 1 from impairing the user's visibility when the inventive tweezers are used. This position also allow the wide part of the frame structure 1 to be held properly in the palm of the user's hand whilst ensuring an optimum access to the extremity 2. The one skilled in the art will however understand that other positions are possible for the extremity 2. It can in particular be centered relatively to the branches 3 and/or connected to the latter along an axis parallel to their longitudinal axis.

The width of the branches 3 makes it possible to offer the user a considerable resting surface for actuating the tweezers against the spring force of the blades 30. Even a person of reduced dexterity is thus capable of easily holding the inventive tweezers between two fingers to close it. Furthermore, the width of the branches 3 prevents the latter from sliding between the user's fingers and/or the tweezers from turning involuntarily when they are closed, even strongly or askew.

The width of the branches 3 further gives a better stability of the frame structure 1 relatively to the extremity 2.

The width of the frame structure 1, in particular the considerable surface of the branches 3, further allows additional elements to be fastened there easily, making it possible for example to further enlarge the resting surface on the branches 3, to present a more agreeable and less slippery contact surface than that of the frame structure and/or to give the inventive tweezers a particular aspect, for example for aesthetic, ergonomic and/or advertisement purposes. According to a variant embodiment of the invention described further below, the additional element or elements fastened on the branches 3 also allow new functionalities to be added to the inventive tweezers.

According to a preferred embodiment of the inventive tweezers, the branches 3 includes fastening elements, for example openings 38 39 and/or notches 37 making it possible for example by removably clipping-on or snapping-on to fasten thereon additional elements of moulded or injected synthetic materials provided with suitable fastening elements designed to work with those of the branches 3.

FIG. 4 to 6 illustrate for example a variant embodiment of the invention where each branch 3 includes a cover 9 fastened onto its outer surface and nearly fully covering it. According to this embodiment, the covers 9 thus give the tweezers a particular aesthetic aspect while further enlarging the usable resting surfaces for actuating them. Each cover 9 preferably includes fastening elements 97, 99 partially visible in the FIGS. 4 and 6 and working with the openings 39 and the notches 37 of the corresponding branch 3.

In the illustrated example, the covers 9 are in a heart shape and thus present an obvious aesthetic aspect. The one skilled in the art will however understand that other covers are also conceivable within the frame of the invention. The latter's shape and/or material can in particular be varied at will in order to give the inventive tweezers the ease of use and/or the aesthetic aspect desired. The covers can for example provide a particularly ergonomic resting surface, adapted for example for left-handers or right-handers. They can also be decorative elements related to jewelry and include precious materials, set stones, etc. They can also include advertising inscription. The one skilled in the art will also understand that the additional elements fastened on the frame structure 1 cannot entirely cover its outer surface.

According to another variant embodiment of the invention, the additional elements fastened onto the branches 3 provide additional functionalities to the inventive tweezers 1. According to this embodiment, at least one of the additional elements includes for example a watch, a thermometer, a lamp for example for lighting the extremity 2 when a pressure is exerted on the branches 3, etc.

The additional elements, for example the covers 9, are preferably fastened in removable fashion onto the branches 3 so that they can be easily substituted without particular tool or risk of irreversibly damaging the tweezers 1. According to the invention, it is thus possible to propose to the user several different additional elements each providing for example other functionalities, other ergonomics and/or a different aesthetic aspect. The user is thus capable of adapting the inventive tweezers to his tastes and/or needs by fastening the additional elements of his choice from among those available.

One advantage of the inventive tweezers 1 is that, given the width of the branches 3 and their small length, they are not considered dangerous objects according to the new norms in force in the field of air transport. They can thus be carried by a traveler on board the plane cabin and used during the journey.

According to the preferred embodiment of the invention described further above, the two branches 3 of the tweezers 1 are considerably wider than the flat extremity 2, preferably at least as wide as the thumb of an adult user of average corpulence. According to a variant embodiment of the invention, only one branch is large and comprises for example the fastening elements for fastening an additional element, whilst the other branch is narrow and elongated, similar to a branch of prior art tweezers.

According to the preferred embodiment of the invention described further above, the frame structure 1 of the inventive tweezers is metallic and includes the extremity 2 of the same material. The one skilled in the art will however understand that it is also conceivable, within the frame of the invention, to imagine a frame structure of another material, for example of moulded or injected synthetic material, having a metallic extremity 2 constituted for example of a pair of metallic tips fastened, for example mounted, to the synthetic frame structure.

The invention claimed is:

1. Tweezers for cosmetic use, comprising two branches, said two branches extending substantially along an entire length of said tweezers, each branch having one metallic extremity for seizing small objects, the maximum width of said two branches being at least equal to half their maximum length along at least half of the maximum length of the tweezers, each of said two branches includes a beginning which defines a first extremity of the tweezers along at least a portion of the width of the tweezers, and an end which defines a second extremity of the tweezers wherein each of said two branches has at least one flexible blade connected to it, the at least one flexible blade being arranged to be substantially on the same plane as the branch to which it is connected and placed on the side of said branch to which it is connected, and wherein said at least one flexible blade constitutes a fraction of the maximum width of the branch, and further wherein said tweezers further comprise one or more rigid connecting zones connecting the at least one flexible blade of one branch with the flexible blade of the other branch.

2. The tweezers of claim 1, having a metallic frame structure, said frame structure including said two branches and said extremity.

3. The tweezers of claim 1, the maximum width of said two branches being greater than half the maximum length of said two branches.

4. The tweezers of claim 1, the maximum width of said extremity being less than a third of the maximum width of said two branches.

5. The tweezers of claim 4, the maximum width of said extremity being less than a fifth of the maximum width of said two branches.

6. The tweezers of claim 1, said at least one flexible blade having a recess portion for controlling the flexibility of the blade.

7. The tweezers of claim 1, each of said two branches having two flexible blades, each flexible blade on one of said two branches extending to the corresponding flexible blade of the other of said two branches.

8. The tweezers of claim 1, the flexible blades of two branches being connected to one another through the rigid connecting zones, the connecting zones perpendicularly intersecting the flexible blades.

9. The tweezers of claim 8, said connecting zones determining the distance between said two branches.

10. The tweezers of claim 9, said distance being determined so that said two branches are substantially parallel when said tweezers are open in resting position.

11. The tweezers of claim 8, said connecting zones being formed in the extension of said flexible blades, the width of said connecting zones being greater than the width of said flexible blades.

12. The tweezers of claim 1, having a frame structure with said two branches, said frame structure being formed by electro-discharging a metallic plate.

13. The tweezers of claim 12, formed by folding said frame structure.

14. The tweezers of claim 1, at least one of said two branches including fastening elements for fastening an additional decorative element.

15. The tweezers of claim 14, said additional decorative element being a cover covering at least partially the outer surface of said at least one of said two branches.

16. The tweezers of claim 14, said additional element having a resting surface greater than the outer surface of said at least one of said two branches.

17. The tweezers of claim 14, said additional element being of moulded or injected synthetic material.

18. The tweezers of claim 1, said extremity being off-center relatively to said two branches.

19. The tweezers of claim 1, said extremity being off-axis relatively to said two branches.

20. The tweezers of claim 1, wherein the maximum width of said two branches is greater than 20 mm.

21. The tweezers of claim 1, wherein the maximum length of said two branches is less than 55 mm.

22. Tweezers according to claim 1, wherein at least one of said two branches including fastening elements for fastening an additional decorative element, said additional decorative element having a heart shape.

23. The tweezers of claim 22, said additional element having a resting surface greater than the outer surface of said at least one of said two branches.

24. Tweezers according to claim 1 wherein said one metallic extremity is positioned at a first end while the at least one flexible blade is positioned at a second end.

25. Tweezers for cosmetic use, comprising a metallic folded frame structure defining two symmetrical branches, at least two flexible blades connected to each branch, and rigid connecting zones connecting the flexible blades of one branch with the corresponding flexible blades of the other branch, said flexible blades being substantially in the same plane than said branches and placed on the side of said branches, said rigid connecting zones determining the distance between said flexible blades, wherein the maximum width of both branches is greater than 20 mm, wherein the maximum length of both branches is less than 55 mm, and wherein the maximum width of said two branches is at least equal to half their maximum length, and wherein each of said two branches includes a beginning which defines a first extremity of the tweezers along at least a portion of the width of the tweezers, and an end which defines a second extremity of the tweezers.

26. The tweezers of claim 25, further comprising a synthetic cover fastened to each branch and having a resting surface greater than the outer surface of said branch.

* * * * *